US008186521B2

(12) United States Patent
Yu

(10) Patent No.: US 8,186,521 B2
(45) Date of Patent: May 29, 2012

(54) WALL RACK

(75) Inventor: Hsien-Jui Yu, Changhua County (TW)

(73) Assignee: Dongguan Master United Plastic & Hardware Products Co., Ltd., Dongguan, Guandong Province (CN)

( * ) Notice: Subject to any disclaimer, the term of this patent is extended or adjusted under 35 U.S.C. 154(b) by 354 days.

(21) Appl. No.: 12/654,884

(22) Filed: Jan. 7, 2010

(65) Prior Publication Data

US 2011/0163054 A1 Jul. 7, 2011

(51) Int. Cl.
*A47F 5/08* (2006.01)
*A47H 1/00* (2006.01)

(52) U.S. Cl. ..... 211/106; 211/119.009; 211/90.03; 211/119

(58) Field of Classification Search ..... 211/106, 211/106.01, 119.009, 119.004, 90.02–90.04, 211/103, 119, 85.31, 181.1, 117, 133.5, 133.2, 211/126.9, 187, 193, 88.01–88.03, 112; 248/302, 248/303, 317, 323

See application file for complete search history.

(56) References Cited

U.S. PATENT DOCUMENTS

| | | | | |
|---|---|---|---|---|
| 2,672,988 | A * | 3/1954 | Johnson | 211/88.01 |
| 5,031,783 | A * | 7/1991 | Goudreau | 211/181.1 |
| 5,588,543 | A * | 12/1996 | Finger | 211/90.01 |
| 5,875,902 | A * | 3/1999 | Emery et al. | 211/90.03 |
| 6,520,351 | B1 * | 2/2003 | Zadro | 211/119 |
| 6,564,950 | B1 * | 5/2003 | Holm | 211/85.31 |
| 7,178,681 | B2 * | 2/2007 | Libman | 211/106 |
| 2003/0160014 | A1 * | 8/2003 | Cuzzocrea | 211/113 |
| 2005/0263466 | A1 * | 12/2005 | Libman | 211/106 |
| 2006/0180557 | A1 * | 8/2006 | Weinstein et al. | 211/40 |
| 2008/0164384 | A1 * | 7/2008 | Rosen | 248/117.1 |

* cited by examiner

*Primary Examiner* — Jennifer E. Novosad
(74) *Attorney, Agent, or Firm* — Bacon & Thomas, PLLC

(57) ABSTRACT

A wall rack includes two parallel sliding rails each having a plurality of protrusions spaced along the length, a frame having two pairs of first hooks at the front side, two stop members respectively connected to the first hooks and two pairs of second hooks hooked on and movable along the sliding rails, a storage basket having two mounting rods respectively secured to the first hooks, and a positioning device formed of an axle that is pivotally coupled to the frame, a retaining rod and a bearing member and biasable relative the frame to lock the frame to the sliding rails where the retaining rod is stopped at the top side of one protrusion of each of the two sliding rails and the bearing member is stopped against one stop member of the frame.

7 Claims, 4 Drawing Sheets

WALL RACK

BACKGROUND OF THE INVENTION

1. Field of the Invention

The present invention relates to storage racks and more particularly, to a wall rack, which allows adjustment of the elevation of the storage basket thereof conveniently and safely.

2. Description of the Related Art

Wall racks are intensively used in every family for holding things. A wall rack generally comprises a mounting frame to be affixed to the wall of a bathroom, bedroom or reading room with screws, and a storage basket affixed to the mounting frame for holding things. After installation of a wall rack, the elevation of the storage basket is not adjustable.

To facilitate the use of a wall rack, the storage basket may be made detachable. After installation of the mounting frame to a wall, the user can attach the storage basket to the mounting frame at one of a series of vertically spaced positions. However, because the storage basket can be fastened to the mounting frame only through a specific angle, the mounting operation is inconvenient. Further, if the wall rack is not properly handled after separation of the storage basket, an accident may occur during delivery of the wall rack.

SUMMARY OF THE INVENTION

The present invention has been accomplished under the circumstances in view. It is the main object of the present invention to provide a wall rack, which allows the user to adjust the elevation of the storage basket of the wall rack.

It is another object of the present invention to provide a wall rack, which allows adjustment of the elevation of the storage basket without separation of the storage basket from the sliding rails so that the user can adjust and lock the storage basket to the desired elevation safely.

To achieve these and other objects of the present invention, a wall rack comprises two sliding rails arranged in parallel, a positioning assembly and a storage basket. Each sliding rail has a plurality of protrusions spaced along the length. The protrusions of one sliding rail are respectively aimed at the protrusions of the other sliding rail. The positioning assembly comprises a frame and a positioning device. The frame has two pairs of first hooks respectively forwardly extended from the top and bottom sides at the two opposite lateral sides thereof, two stop members respectively disposed at the top side in front of the first hooks, two pairs of second hooks respectively backwardly extended from the top and bottom sides at the two opposite lateral sides and respectively hooked on and movable along the two sliding rails and two rings bilaterally and fixedly located on the front side between the two pairs of first hooks and axially aligned in line. The positioning device comprises an axle, a retaining rod and a bearing member. The axle is inserted through the two rings and pivotally coupled to the frame. The retaining rod is fixedly connected to the axle and extending backwards from the axle. The storage basket has two mounting rods arranged at the rear side at different elevations in a parallel manner and attachable to the two pairs of first hooks of the frame respectively. Further, the positioning device is biasable relative to the frame between a first position and a second position. When the positioning device is moved from the second position to the first position, the retaining rod is backwardly inserted through the frame and stopped at the top side of one protrusion of each of the two sliding rails, and the bearing member is stopped against one stop member of the frame to lock the positioning assembly to the sliding rails. When the positioning device is moved from the first position to the second position, the retaining rod is moved away from the protrusions of the sliding rails and the bearing member is moved away from the stop members of the frame for allowing movement of the frame along the sliding rails.

Thus, the user can adjust the elevation of the positioning assembly and the storage basket relative to the sliding rails conveniently without separation of the storage basket from the frame.

DETAILED DESCRIPTION OF THE INVENTION

Figure 1:
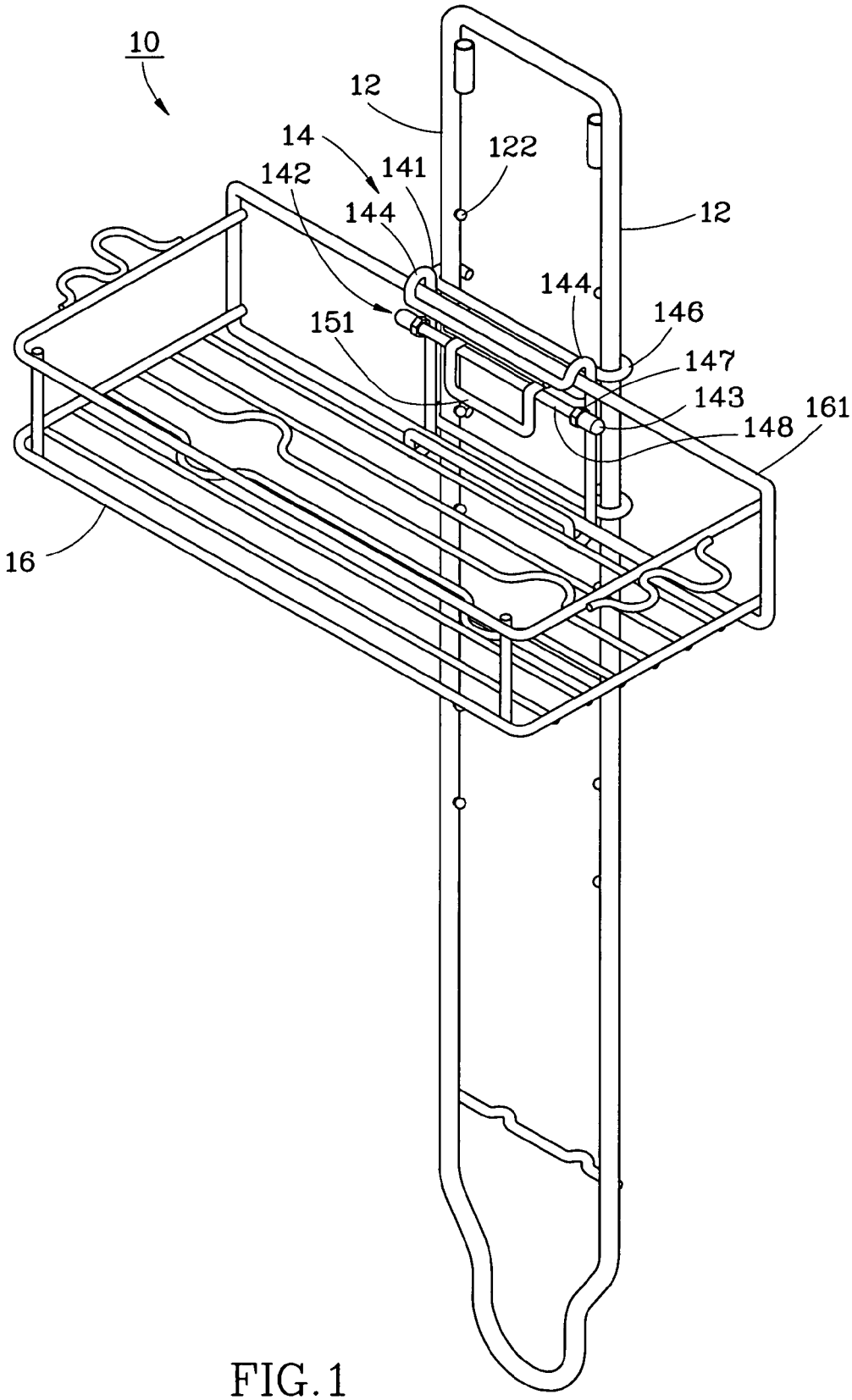
FIG. 1 is an elevational view of a wall rack in accordance with the present invention.
Figure 2:
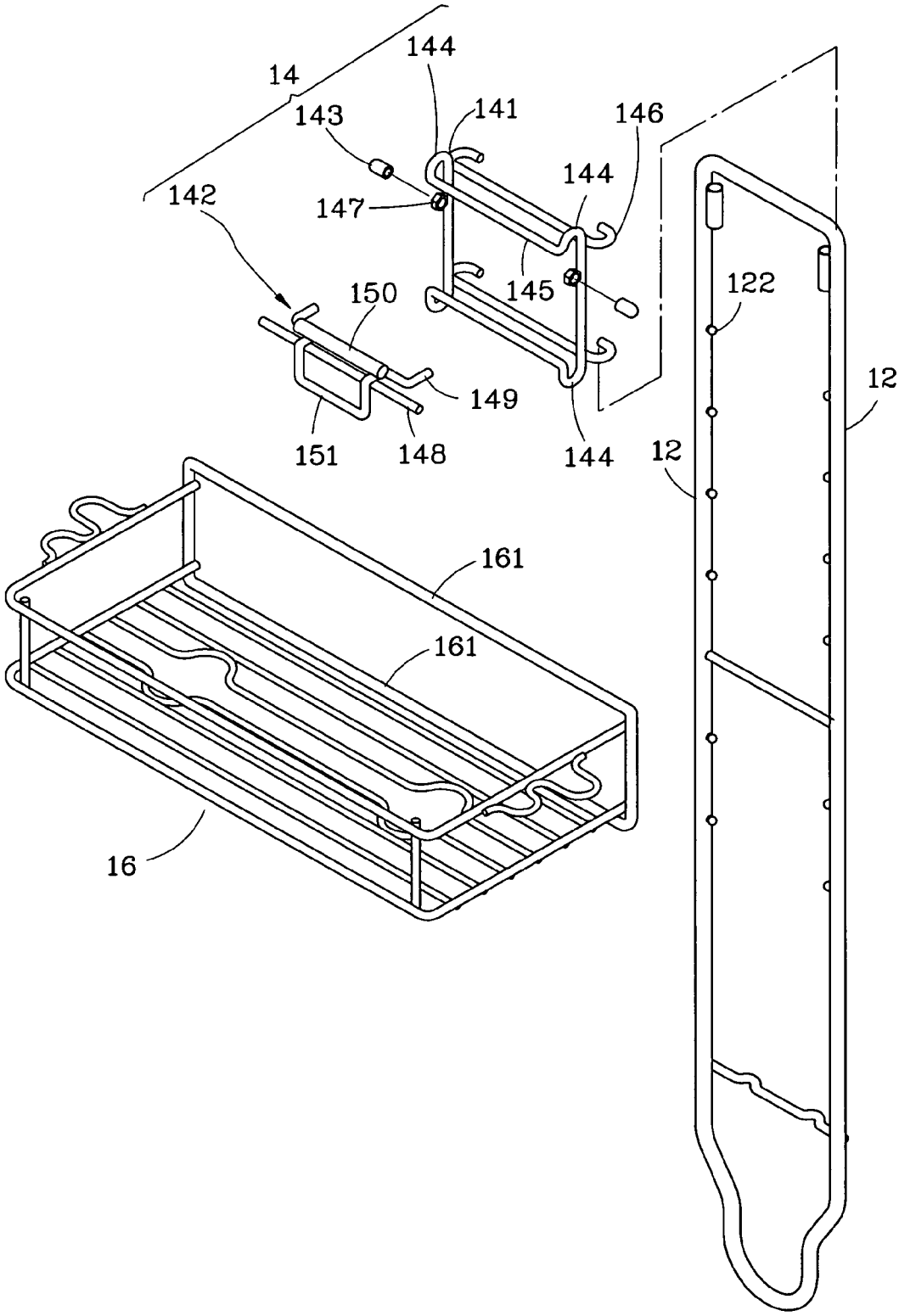
FIG. 2 is an exploded view of the wall rack in accordance with the present invention.

Referring to FIGS. 1-4, a wall rack 10 in accordance with the present invention is shown comprising two sliding rails 12, a positioning assembly 14 and a storage basket 16.

The two sliding rails 12 are fastened to a wall and arranged in parallel, each having a plurality of protrusions 122 spaced along the length thereof. The protrusions 122 of one of the two sliding rails 12 are respectively aimed at the protrusions 122 of the other sliding rail.

The positioning assembly 14 comprises a frame 141, a positioning device 142 and two caps 143.

The frame 141 has two pairs of first hooks 144 respectively forwardly extended from the two opposite lateral sides at the top and bottom sides thereof, two stop members 145 respectively connected between the first hooks 144 and arranged in parallel at the top and bottom sides, two pairs of second hooks 146 respectively backwardly extended from the two opposite lateral sides, and two rings 147 bilaterally and fixedly located on the front side between the two pairs of first hooks 144.

The positioning device 142 comprises an axle 148, a retaining rod 149 and a bearing member 150. The axle 148 is pivotally coupled to the frame 141 by means of inserting its two distal ends into the two rings 147. The retaining rod 149 is fixedly connected to the axle 148 and extending backwards from the axle 148. According to the present preferred embodiment the positioning device 142 further comprises a handlebar 151 forwardly extended from the retaining rod 149. Therefore, the user can operate the handle 151 to move the retaining rod 149. Further, the handle 151 and the retaining rod 149 define a contained angle within 60°~150°. Thus, the user's hand can grasp the handle 151 conveniently. The bearing member 150 according to the present preferred embodiment is a rod member fixedly fastened to the retaining rod 149 adjacent to the axle 148. Thus, the retaining rod 149 and the axle 148 can be moved at the same time. Alternatively, the bearing member 150 can be affixed to the axle 148, achieving the same effect.

The positioning device 142 can be biased relative to the frame 141 between a first position P1 and a second position P2. When the positioning device 142 is in the first position P1, the retaining rod 149 is backwardly inserted through the frame 141 and stopped at the top of one protrusion 122 of each of the two sliding rails 12, and the bearing member 150 is stopped against one stop member 145 of the frame 141. Thus, the positioning assembly 14 is locked to the sliding rails 12. On the contrary, when the positioning device 142 is in the second position P2, the retaining rod 149 is kept away from the protrusions 122 of the sliding rails 12 and the bearing member 150 is kept away from the stop members 145 of the frame 141, allowing movement of the positioning assembly 14 along the sliding rails 12.

The two caps 143 are respectively capped on the two distal ends of the axle 148 after insertion of the two distal ends of the axle 148 through the rings 147. The caps 143 have an outer diameter greater than the inner diameter of the rings 147. Therefore, the axle 148 is kept in the rings 147 and prohibited from fall out of the rings 147.

The storage basket 16 has two mounting rods 161 arranged at the rear side thereof at different elevations in a parallel manner and attachable to the two pairs of first hooks 144 of the frame 141 respectively.

Figure 3:
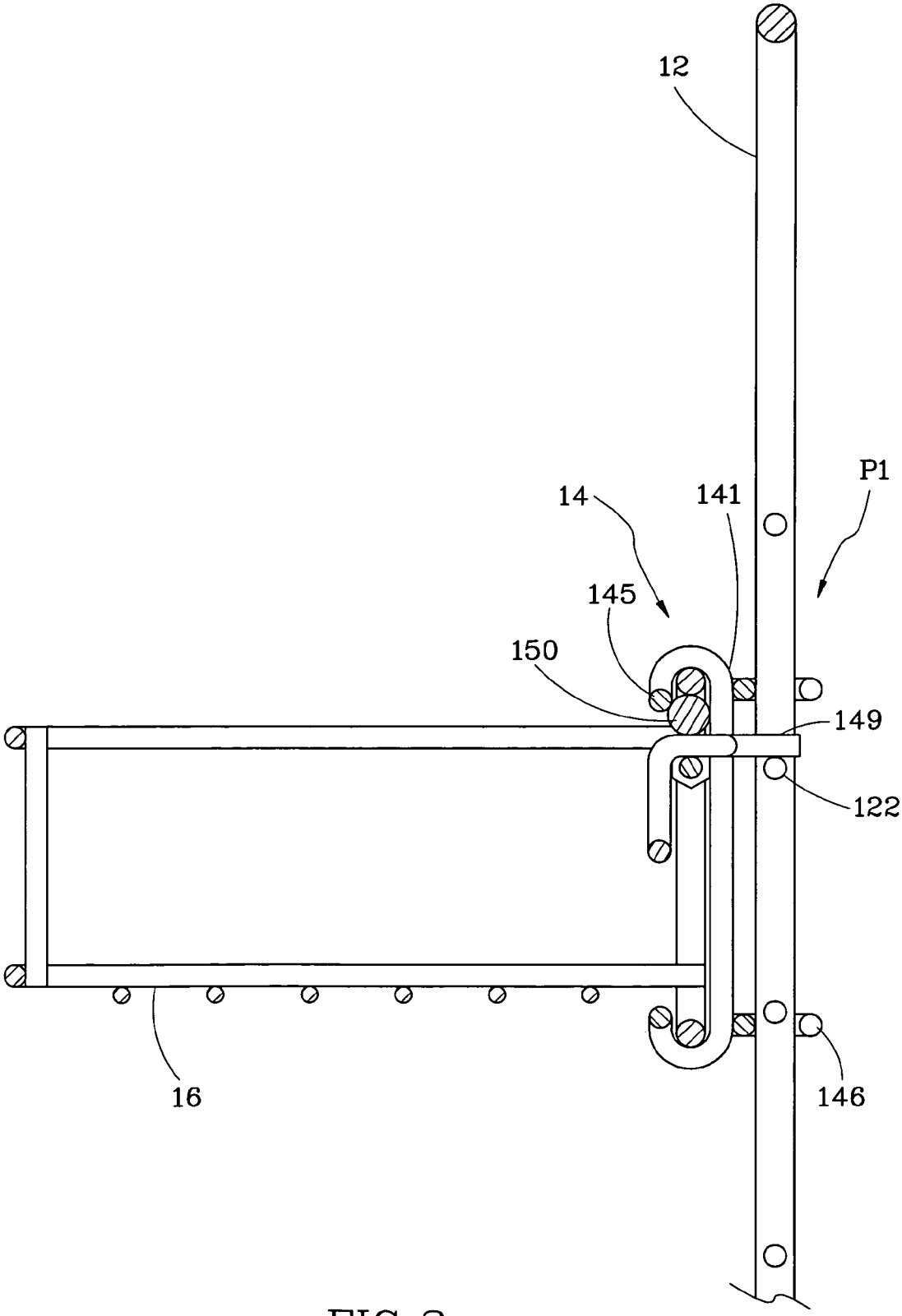
FIG. 3 is a sectional side view of the present invention, showing the positioning device in the first position.

The operation of the present invention is outlined hereinafter. As shown in FIG. 3, when the positioning device 142 is in the first position P1, the retaining rod 149 is backwardly inserted through the frame 141 and stopped at the top of one protrusion 122 of each of the two sliding rails 12. At this time, the two protrusions 122 impart a reaction force to the retaining rod 149, causing the bearing member 150 to bias forwards. Because one stop member 145 of the frame 141 is disposed in front of the bearing member 150, the bearing member 150 is forced to stop against the respective stop member 145. Thus, the positioning assembly 14 is locked to the sliding rails 12. At this time, the user can place things in the storage basket 16.

Figure 4:
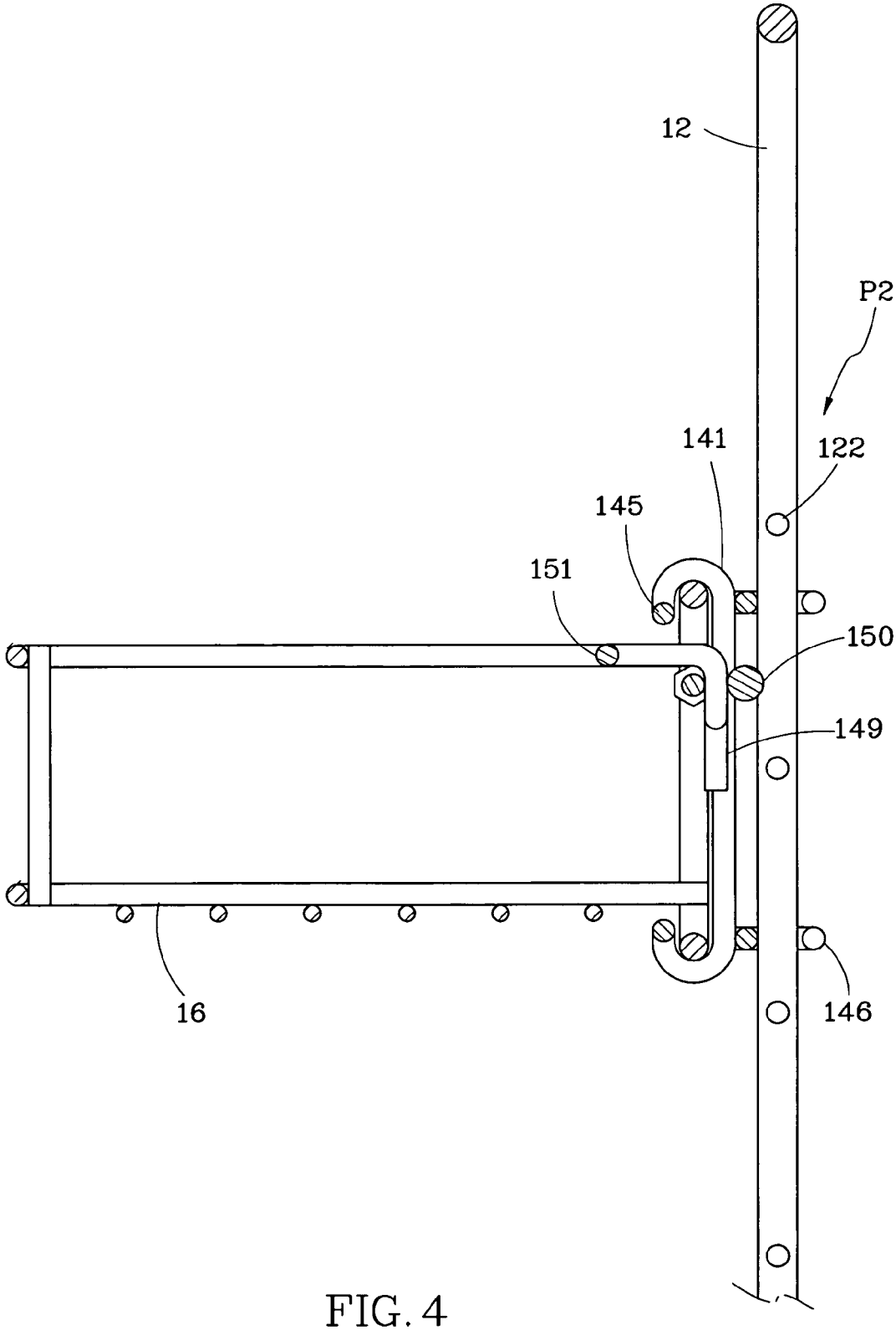
FIG. 4 is a sectional side view of the present invention, showing the positioning device in the second position.

Referring to FIG. 4, when the user wishes to adjust the elevation of the storage basket 16, operate the handle 151 to move the positioning device 142 to the second position P2. At this time, the retaining rod 149 is biased backwardly downwards and moved apart from the protrusions 122 of the sliding rails 12. Thus, the positioning assembly 14 is unlocked from the sliding rails 12. At this time, the positioning assembly 14 can be moved along the sliding rails 12 to carry the storage basket 16 to the desired elevation. When adjusting the elevation of the positioning assembly 14, the second hooks 146 are kept coupled to the sliding rails 12. Therefore, it is not necessary to separate the storage basket 16 from the positioning assembly 14 during adjustment of the elevational position of the storage basket 16. When reached the desired position, bias the positioning device 142 from the second position P1 to the first position P1 to lock the frame 141 to the sliding rails 12 again.

Subject to the aforesaid arrangement, the invention has the advantages as follows:

1. The elevation of the storage basket 16 is adjustable so that the user can conveniently adjust the storage basket 16 to the desired elevation.

2. The storage basket 16 can be adjusted to the desired elevation without separation from the sliding rails 12 so that the user can adjust and lock the storage basket 16 to the desired elevation safely.

What is claimed is:

1. A wall rack, comprising:

two sliding rails arranged in parallel, each said sliding rail having a plurality of protrusions spaced along the length thereof, the protrusions of one said sliding rail being respectively aimed at the protrusions of the other said sliding rail;

a positioning assembly, said positioning assembly comprising a frame and a positioning device, said frame having two pairs of first hooks respectively forwardly extended from top and bottom sides at two opposite lateral sides thereof, two stop members respectively disposed at the top side in front of said first hooks, two pairs of second hooks respectively backwardly extended from the right and left sides at the two opposite lateral sides and respectively hooked on and movable along said two sliding rails and two rings bilaterally and fixedly located on the front side between said two pairs of first hooks and axially aligned in line, said positioning device comprising an axle, a retaining rod and a bearing member, said axle being inserted through said two rings and pivotally coupled to said frame, said retaining rod being fixedly connected to said axle and extending backwards from said axle; and a storage basket, said storage basket having two mounting rods arranged at a rear side thereof at different elevations in a parallel manner and attachable to the two pairs of first hooks of said frame respectively; and wherein said positioning device is biasable relative to said frame between a first position and a second position; when said positioning device is moved from said second position to said first position, said retaining rod is backwardly inserted through said frame and stopped at a top side of one protrusion of each of said two sliding rails, and said bearing member is stopped against one stop member of said frame to lock said positioning assembly to said sliding rails; when said positioning device is moved from said first position to said second position, said retaining rod is moved away from the protrusions of said sliding rails and said bearing member is moved away from the stop members of said frame for allowing movement of said frame along said sliding rails.

2. The wall rack as claimed in claim 1, wherein said two stop members are respectively connected between said first hooks and arranged in parallel at the top and bottom sides.

3. The wall rack as claimed in claim 2, wherein said positioning assembly further comprises two caps respectively capped on two distal ends of said axle of said positioning device.

4. The wall rack as claimed in claim 1, wherein said positioning device further comprises a handle forwardly extended from said retaining rod.

5. The wall rack as claimed in claim 4, wherein said handle and said retaining rod define a contained angle within 60°~150°.

6. The wall rack as claimed in claim 1, wherein said bearing member is a rod member fixedly fasted to said retaining rod adjacent to said axle.

7. The wall rack as claimed in claim 1, wherein said bearing member is a rod member fixedly fastened to said axle.

* * * * *